US008720357B2

(12) United States Patent
Nemeth et al.

(10) Patent No.: US 8,720,357 B2
(45) Date of Patent: May 13, 2014

(54) PASSENGER-ROTATABLE BOAT

(75) Inventors: Edward A. Nemeth, Hermosa Beach, CA (US); David W. Crawford, Long Beach, CA (US); Matthew P. Meyer, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 321 days.

(21) Appl. No.: 13/366,497

(22) Filed: Feb. 6, 2012

(65) Prior Publication Data

US 2013/0199431 A1 Aug. 8, 2013

(51) Int. Cl.
*B63H 25/04* (2006.01)
*B63H 25/10* (2006.01)

(52) U.S. Cl.
USPC ..... 114/144 R

(58) Field of Classification Search
CPC ..... B63H 25/00; B63H 25/06; B63H 25/08; B63H 25/10; B63H 25/44; B63H 25/52; B63B 1/283; B63B 25/286
USPC ..... 441/35, 37, 40; 114/56.1, 58, 59, 61.32, 114/271, 278, 280, 281, 343, 345, 364, 114/144 R, 145 R, 147, 150
See application file for complete search history.

(56) References Cited

U.S. PATENT DOCUMENTS 1,722,523 A 7/1929 Hunter
2,058,383 A * 10/1936 Maynes ..... 114/55.5
3,207,509 A 9/1965 Meyering
3,913,159 A 10/1975 Thomas
3,954,084 A 5/1976 Cronin
4,021,873 A * 5/1977 Francois ..... 114/345
4,367,689 A * 1/1983 Lukehart et al. ..... 114/346
4,516,943 A 5/1985 Spieldiener
5,118,094 A 6/1992 Lambert
5,299,964 A 4/1994 Hopkins
6,840,830 B1 * 1/2005 Harlan ..... 441/35
7,404,371 B2 * 7/2008 Schmitt ..... 114/346
7,854,663 B2 12/2010 Burger
8,047,886 B1 * 11/2011 McLarty et al. ..... 441/66

FOREIGN PATENT DOCUMENTS

DE 3525621 A1 1/1987

* cited by examiner

*Primary Examiner* — Daniel V Venne
(74) *Attorney, Agent, or Firm* — Marsh Fischmann & Breyfogle LLP; Kent A. Lembke

(57) ABSTRACT

A boat configured for rotating in response to passenger inputs such as rotation of a wheel or pumping a hand pump. The boat includes a hull with an upper portion for receiving at least one passenger and a lower portion comprising a bottom contact surface. Further, the boat includes a rider interface, provided on the upper portion of the hull, that is configured for receiving physical input from the passenger. The boat also includes a torque producing assembly with a boat-to-water interface provided on the lower portion below a waterline region and above bottom contact surface. The boat-to-water interface applies a force to water adjacent to the lower portion of the hull in response to the received physical input, whereby the boat rotates due to a resistive force applied by the water in response to the applied force.

7 Claims, 7 Drawing Sheets

PASSENGER-ROTATABLE BOAT

BACKGROUND

1. Field of the Description

The present description relates, in general, to passenger boats such as round rafts and passenger control of boat motion, and, more particularly, to a passenger boat adapted to respond to passenger input, such as rotation of a wheel or pumping a pump handle, with rotation of the boat hull about a rotation axis.

2. Relevant Background

In amusement parks and many other settings, entertainment is provided that involves passengers riding on boats in still and moving water. For example, resorts may provide rafts, kayaks, and paddleboats to their guests to allow them to play in the water. In amusement parks, many rides have been designed and implemented that provide a river rafting experience that may simulate whitewater rafting. Passengers typically enter a boat such as a round raft in a station, and water flowing in a channel moves the passenger boats down the channel and may even cause the boat to flow over rapids and under waterfalls or spraying water.

In rafting rides and other applications, the passengers may be provided little or no control over movement of their boat. Typically, the passengers are not provided any paddles and cannot steer their boat as it moves in the flowing water. It is typically a random outcome that determines which passengers are drenched by a waterfall or positioned near a ride attraction such as a robotic character along the shore of the channel. While such randomness can be exciting to the passengers, there is a demand for water rides and boats for use in other entertainment settings that allow the passengers more control over the movement of the boat or the relative positioning of the passengers to the direction of travel such as to move one passenger into or out of the path of an upcoming waterfall or spray.

SUMMARY

The boats of the present description address the above problems by providing a hull such as a round raft-type floating structure. In some exemplary embodiments, a recessed space or cavity is provided in the lower portion of the hull, and a paddle assembly is positioned within this cavity. The boat further includes a number of passenger seats on the upper portion of the hull, and these seats may face inward toward the center where a rotary handle or wheel may be provided. The rotary handle (or passenger interface) allows the passengers to provide physical input or force, and a drive shaft extends from the handle or wheel down through the hull to connect with the paddle assembly.

Each paddle may extend outward transverse to the shaft, and these paddles rotate with the drive shaft in the cavity. Water in the cavity resists movement of the paddles such that a resistive force or torque is applied to the paddle blades. This resistive force or torque is transmitted to the hull via the drive shaft, the handle, and the seated passengers such that the boat rotates in a direction opposite to the direction the wheel or handle is turned (or is attempted to be turned by the passengers).

More particularly, a boat is provided that is configured for rotating in response to passenger inputs. The boat includes a hull with an upper portion for receiving at least one passenger and a lower portion comprising a bottom contact surface. Further, the boat includes a rider interface, provided on the upper portion of the hull, that is configured for receiving physical input from the passenger. The boat also includes a torque producing assembly with a boat-to-water interface provided on the lower portion below a waterline region and above the bottom contact surface. The boat-to-water interface applies a force to water adjacent to the lower portion of the hull in response to the received physical input, whereby the boat rotates due to a resistive force applied by the water in response to the applied force.

In some embodiments, the boat-to-water interface comprises at least two nozzles positioned in spaced apart positions along a periphery of the lower portion of the hull. In such boats, the rider interface includes a manual water pump operable by the passenger to pump portions of the water through at least one of the nozzles. Further, the upper portion may include a number of seats for receiving the passengers, and the rider interface includes an independently operable one of the water pumps positioned proximate to each of the seats. Still further, the boat-to-water interface may be adapted such that the nozzles are fluidically and separately connected with one of the water pumps.

In other embodiments of the boat, the lower portion includes a cavity extending upward from the bottom contact surface and defining a space for receiving the boat-to-water interface. In such boats, the boat-to-water interface may include a paddle assembly with two or more paddles rotatable in a volume of the water in the cavity in response to the received physical input. An end of each shaft of each of the paddles may then be attached to a drive shaft rotating with the received physical input. The paddle shafts may extend outward in a spaced-apart manner transverse to the drive shaft. The drive shaft extends into the upper portion of the hull and is coupled to the rider interface (e.g., to a rotary wheel or handle).

DETAILED DESCRIPTION OF THE PREFERRED EMBODIMENTS

Figure 1:
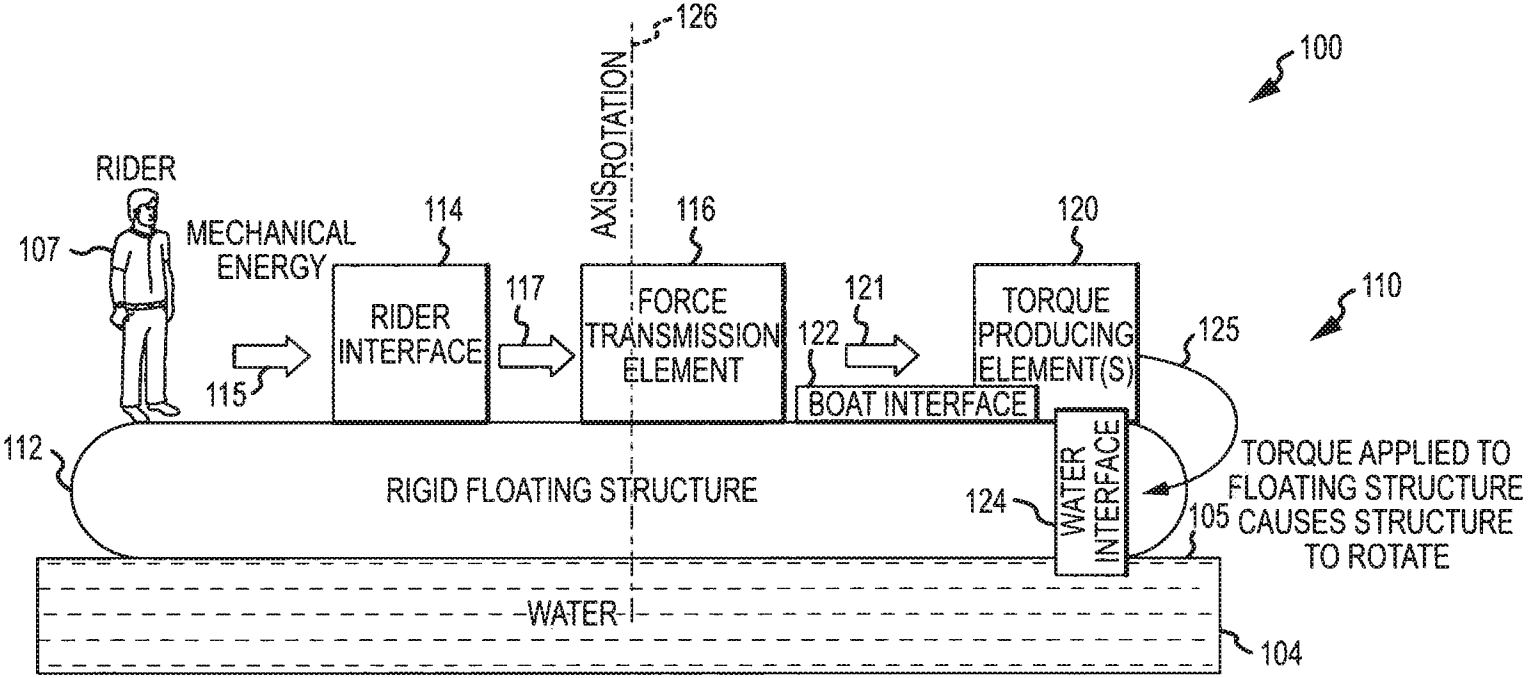
FIG. 1 is a functional block diagram of a boating environment including a boat adapted for rotation on water in response to rider or passenger input (e.g., manual or physical force triggers or causes the boat to rotate in or on the water surface)

Briefly, the following description describes boats (which should be construed broadly to include nearly any floating structure such as a raft, a passenger boat, and the like) that are adapted to rotate in or on the water surface in response to a passenger(s) input. For example, a round raft may have passenger seating for one to four or more passengers or riders, and the riders may manually rotate a wheel or move a pump handle. This input physical force or manual input is translated by a force transmission mechanism or assembly to a torque producing element or assembly, which applies a torque on the boat or its body or hull to cause it to rotate.

In one particular example, a rafting ride may be provided with rider-rotatable boats, and it may be useful to describe such a ride prior to turning to the figures and particular implementations of these boats. The ride includes a water channel in which water is caused to flow to provide a moving waterway. A passenger boat such as a round raft adapted for one to four or more passengers is positioned in the water channel, and the boat may be adapted with seating such that the passengers' bodies rest upon seats and face inwards. A rotary handle extends up from the floor or deck of the boat's body or hull such as in the center of the boat or at an offset location.

The handle (e.g., a large wheel with grips for the passengers) is mounted for rotating by the passengers, and a drive shaft is connected to the rotary handle, and the drive shaft extends from the handle through the floor or deck to a torque generation mechanism or assembly positioned below the waterline. The torque generation mechanism may include one to four or more paddles attached to an end of the drive shaft below the waterline, such as within a cavity in the hull to allow the paddles to rest in or be immersed in the water but be located above a landing or lower surface of the hull (which may contact the bottom of the channel or rollers or the like in the channel that may damage the paddles if not recessed above the bottom of the hull).

When a passenger or rider grasps and rotates the rotary handle, the drive shaft attempts to rotate about its center axis, but the paddles provide resistance to such rotation due to their contact with a volume of water in the channel. As the boat is relatively free to rotate in the water in the channel (or in the flume of the ride), the torque applied by the resistance of the paddles to moving in the water is transferred up through the drive shaft, the rotary wheel, and the passengers bodies to a contact surface with the boat (e.g., the seat or the deck if the passenger is standing). This torque or resistance force causes the boat to rotate about a rotation axis (e.g., the axis of the drive shaft) in a direction opposite to the wheel rotation direction. The paddles may be connected to the passenger-controlled handle/wheel either directly via the drive shaft or through some sort of gearing or other drive assembly/element to increase the mechanical advantage. Instead of paddles and a rotatable drive element, many other assemblies may be utilized to impart a rotational moment to the boat hull or body such as pumped jets of water about the periphery of the hull, propellers in place of paddle blades, and the like.

FIG. 1 illustrates a functional block diagram of a boating environment 100 such as a rafting ride or the like 100. The environment 100 includes a volume of water 104 and a passenger-rotatable boat 110 is shown to be floating on the surface 105 of the water 104. The boat 110 is adapted, such as with seats (not shown), for supporting one or more passengers or riders 107 on a rigid floating structure (e.g., a hull or body) that is buoyant on water surface 105. In practice, a portion of the boat hull or structure 112 will sink below the surface 105 such that the waterline will be some vertical height from a bottom or landing surface of the hull or structure 112.

The boat 110 includes a rider interface 114 accessible by the rider 107, and the rider interface 114 is adapted to allow the rider 107 to physically or manually input mechanical energy (or passenger input) 115. In response, the boat hull or structure 112 rotates 125 about a rotation axis 126. The rider interface 114 may take many forms to implement the boat 110. For example, the interface 114 may be a hand wheel that is rotatable about axis 126 or another axis. In other cases, the interface 114 may take the form of a grip or handle to a pump (e.g., a see-saw type input mechanism where passengers move a pair of opposite handles up and down or a rotary crank). In other cases, the input may be a rotary crank such as found on winches and similar devices. Generally, the rider interface 114 is any device configured for receiving passenger input in the form of mechanical energy and also useful for transmitting resistance to rotation or torque back to the rider/passenger 107 in some embodiments (such as the paddle-type implementations) to move the unrestricted structure 112 on surface 105 (generally, only resistance to rotation 125 is water 104 via contact with portions of the hull 112 below the waterline).

The boat 110 further includes a force transmission element or assembly 116 that is coupled to the rider interface 114. In operation, the rider 107 inputs mechanical energy 115 to the rider interface 114, and this energy 115 is transferred 117 to the force transmission element 116. For example, the transmission element 116 may take the form of an axle or drive shaft extending vertically upward from a deck or floor of the rigid floating structure 112, and this drive shaft may be coupled at a top or first end to the interface 114 (e.g., a wheel or the like). The drive shaft attempts to rotate with the wheel 114 such as about the rotation axis 126, and the transmission element 116 may include a geared transmission (gear train or the like) or other devices to transfer 121 this force to a torque producing element 120. In other cases, the force transmission element 116 may take other forms such as a water pump or a drive train.

The boat 110 includes a torque producing element or assembly 120 that is coupled with the force transmission element 116 to receive the force 121 provided by the rider 107 via interface 114. The torque producing element 120 includes an interface with the water 104 and also an interface 122 with the boat hull 112. In operation, the input force 121 causes the torque producing element 120 to apply a force to the water 104. The water resists this applied force and, in turn, the torque producing element 120 applies a reverse torque to the hull via the boat interface 122, which causes the hull 112 to rotate 125 about the rotation axis 126.

For example, the torque producing assembly 120 may include one to four or more paddles extending transversely outward from a lower or second end of the drive shaft or transmission element 116. The paddles of the assembly 120 may be positioned in a cavity defined by a recessed surface in an underside of the hull or structure 112 such that the paddles are immersed in the water 104 (are below surface 105) but are also protected within the hull 112 as they are positioned within this cavity above a landing surface(s) provided on the underside of the hull or structure 112. In this manner, the water 104 resists movement of the paddles, and this resistance produces a torque that is applied to hull 112 via the force transmission element 116, the rider interface 114, and the passenger 107 (i.e., a contact surface where the passenger contacts the hull 112). In this example, the contact surface is the boat interface 122 and the faces of the paddle blades provide a part of the water interface 124 of the torque producing element 120.

In another embodiment, the force transmission element 116 includes a water pump(s) and the torque producing element 120 includes a number of nozzles directing water. The nozzles may be provided about the periphery of the hull or structure 112 above the surface 105 designed to output water 104 pumped by the transmission element 116 in a pattern into water 104 causing the hull or structure 112 to rotate about axis 126 due to application of torque 125. In still other cases, the force transmission element 126 is a drive train or other assembly that applies a force 121 to the torque producing element 120, which includes one or more propellers (in a cavity or other location in hull 112). The rotation of the propellers in the water 104 applies a torque 125 to the hull 112 to cause it to rotate about axis 126.

Figure 2:
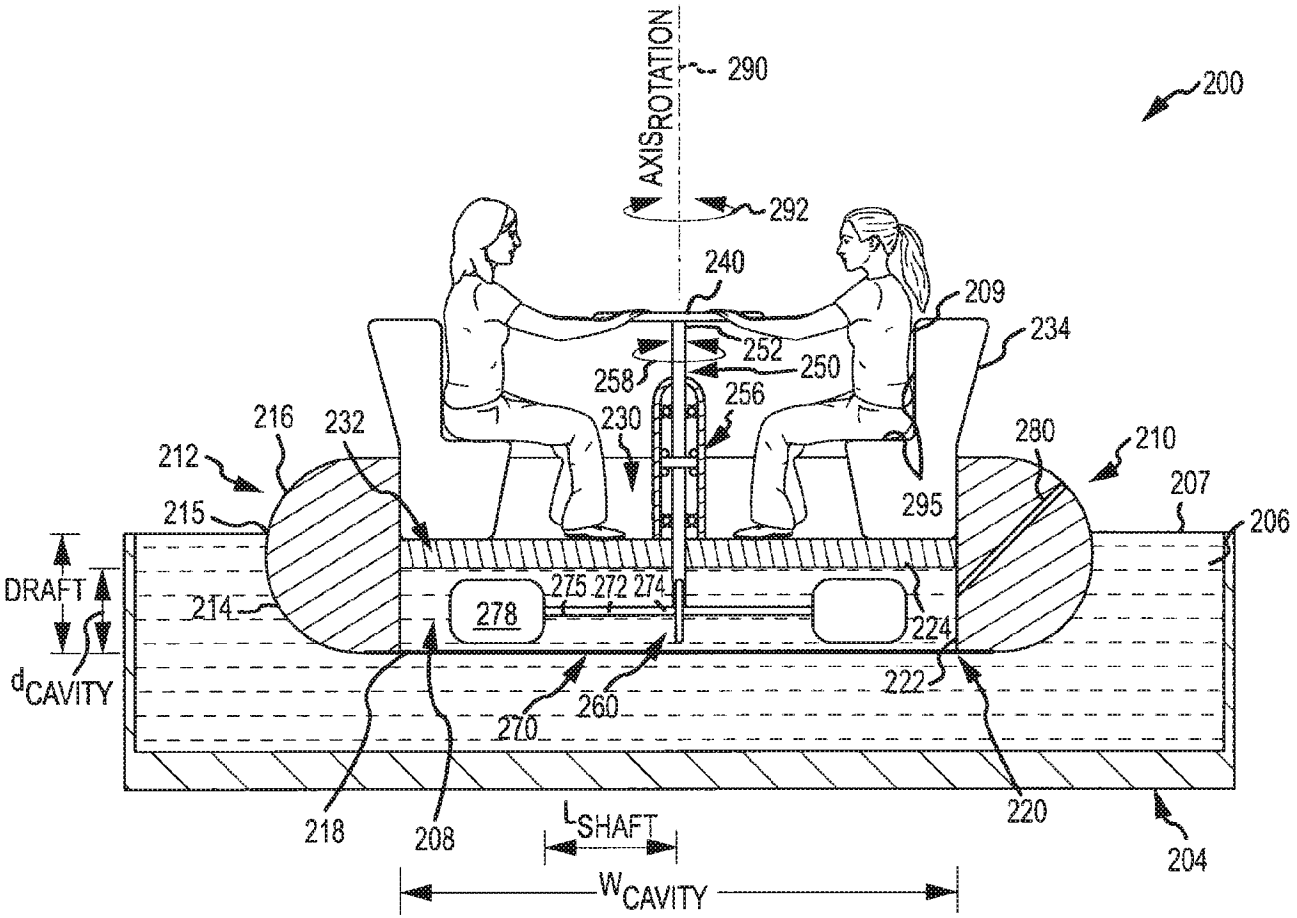
FIG. 2 is a sectional view of a rotatable boat of one embodiment shown floating in volume of water in a water channel such as in a rafting ride or similar boating environment.

FIG. 2 illustrates a sectional view of a passenger-rotatable boat 210 in a boating environment 200. Specifically, the boat 210 is shown to be floating within a channel 204 in a volume of still or flowing water 206. The boat 210 may be a round (or other shape) raft or the like as is often used in rafting rides in amusement parks, and it is shown to include a hull 212 with a lower portion 214 below the waterline 215 (where the hull 212 meets the water surface 207) and an upper portion 216 above the waterline 215. Again, the term "boat" is meant very generally in this description to mean nearly any structure such as one with a hull (e.g., a watertight body) useful for floating in water 206, and, in this light, the hull 212 may be formed of a variety of materials such as plastic (e.g., fiberglass or the like), metal, and/or wood.

The hull 212 includes an interior space or well 230 configured for receiving one, two, or more passengers 209. To this end, seats 234 may be supported within this well such as on a floor or deck 232 upon which the passengers 209 may sit and face inwards (or another direction in other embodiments). In other cases, the passengers 209 may simply stand in the well 230 on deck 232.

Significantly, the boat 210 is adapted such that the passengers 209 may input mechanical energy or force to cause the hull 212 to rotate 292 about an axis of rotation 290. The boat 210 includes a rotary handle or wheel 240 (e.g., a rider interface) positioned to be about chest high in front of the passengers 209 seated in seats 234. The rotary handle 240 is coupled to a drive shaft or axle 250 (e.g. a force transmission element) at a first or upper end 252 of the shaft 250. A support assembly 256 (e.g., with a frame, bearings, and the like) is mounted to the deck 232 to support the drive shaft 250 in a vertical configuration (in this non-limiting example) relative to the deck 232. The shaft 250 is supported such that it can be rotated 252 by the passenger 209 by applying force to the wheel 240.

The boat 210 further includes a paddle assembly 260 (e.g., a torque producing element) that is coupled to the lower or second end 254 of the drive shaft 250, which extends (e.g., in a water-sealed manner or not depending on the location of the penetration relative to the waterline) through the deck 232. Particularly, the shaft 250 extends a distance below the deck 232 to mate with the paddle assembly 260 and allow the passenger-inputted force to be transmitted to the paddle assembly 260. Significantly, the boat 210 includes a cavity 220 in the lower portion of the hull 214, and a volume 208 of the water 206 fills this cavity 220.

The cavity 220 is defined by sidewalls 222 that extend upward a distance, $d_{Cavity}$, to an upper surface (or lower surface of deck 232) 224. The cavity 220 may be cylindrical in shape as shown and centered about the rotation axis 290 in the hull 212. The cavity 220 is provided such that the paddle assembly 260 may be housed wholly (as shown) or partially below a landing surface 218 provided on the lower portion 214 of the hull 212. In this manner, the paddle assembly 260 is protected from damage when the hull 212 contacts the bottom of the channel 204, rollers provided in the channel 204 for moving the boat 210 in the water 206, and other guide or stabilization devices or obstructions in the channel 204.

The paddle assembly 260 includes four paddles 270 each extending traverse (or, in some cases, orthogonally) to the shaft 250 such as at 90 degree intervals. Each paddle 270 includes a shaft 272 attached at a first end 274 to the end 254 of the shaft and at a second end or throat 275 to a paddle blade 278. The width of the cavity, $w_{Cavity}$, is chosen to provide a clearance between the tip of the paddle blade 278 and the sidewalls 222 (such as 1 to 4 inches or more clearance in some cases).

The depth, $d_{Cavity}$, of the cavity 220 is typically chosen to be greater by some amount (1 to 6 inches or more) than the height of the paddle blades 278 such that the blade 278 can be positioned fully within the cavity 220 to be protected by the landing surface 218 of the hull 212. The depth of cavity 220 is also typically some amount less than the expected draft of the boat 210 such that the cavity 220 is more likely to fill with water 208. To further facilitate filling of the cavity 220, pressure release or vent lines 280 may be provided in hull 212 extending between the cavity 220 (or sidewall 222) through the upper portion 216 of the hull 212 so as to allow gases (or air) to be easily pushed out of the cavity 220 and draw in water 208.

The length, $L_{Shaft}$, of the shafts 272 may vary to practice the invention and is typically chosen to achieve a desired mechanical advantage and rotational effect, with a longer shaft 272 (such as 2 to 4 feet or more) being useful to provide a greater lever arm and more torque to turn 292 the boat hull 212 than a shorter shaft 272 (such as less than about 2 feet). The paddle blades 278 may also take a wide variety of shapes and sizes to practice the invention. As shown, the blades 278 are generally rectangular (e.g., 1 foot by 6 inches or the like) with rounded corners, and the bodies of the blades 278 are flat such that the faces are generally planar. However, the bodies of the blades 278 may be curved, and the bodies may take many other shapes such as oval, circular, square, or the like. The surface area of the faces of the bade 278 is also chosen or tuned to achieve a desired turning or rotating effect (e.g., to set the amount of force that passengers have to input via handle 240 to achieve a particular rate of rotation 292 about axis 290). Interestingly, a key aspect is that some resistance to rotation be provided, which indicates the term "paddle" and its "blade" may be construed very broadly in many cases to include a wide variety of body shapes, thicknesses, and sizes as well as materials (e.g., plastic, metal, wood, and the like).

In use, the passengers 290 grip the wheel or handle 240 and input a force or mechanical energy to try to rotate 252 the shaft 250. This causes the end 254 of the shaft 250 to begin to rotate and move the paddles 278 through the water 208 in the cavity 220. The water 208 resists the movement of the paddles 270 and applies a counter active force on the faces of the blades 278. This resistive force creates a torque that is transmitted through the paddle assembly 260 to the shaft 250 and coupled rotary handle or wheel 240 to the passenger 209 who is gripping the handle 240. Hence, a torque or force is passed from the passenger 209 via a contact surface 295 of the seats 234 to the hull 212, which causes the boat 210 to rotate 292 about the rotation axis 290 (which may pass through the center of the drive shaft 250) in a direction generally opposite that of the rotation 252 of the shaft 250. In some embodiments, the passengers 209 may rotate the wheel 240 and shaft 250 in either a clockwise or a counterclockwise direction so as to rotate the boat 210 in either (but, the opposite) direction, too.

Figure 3:
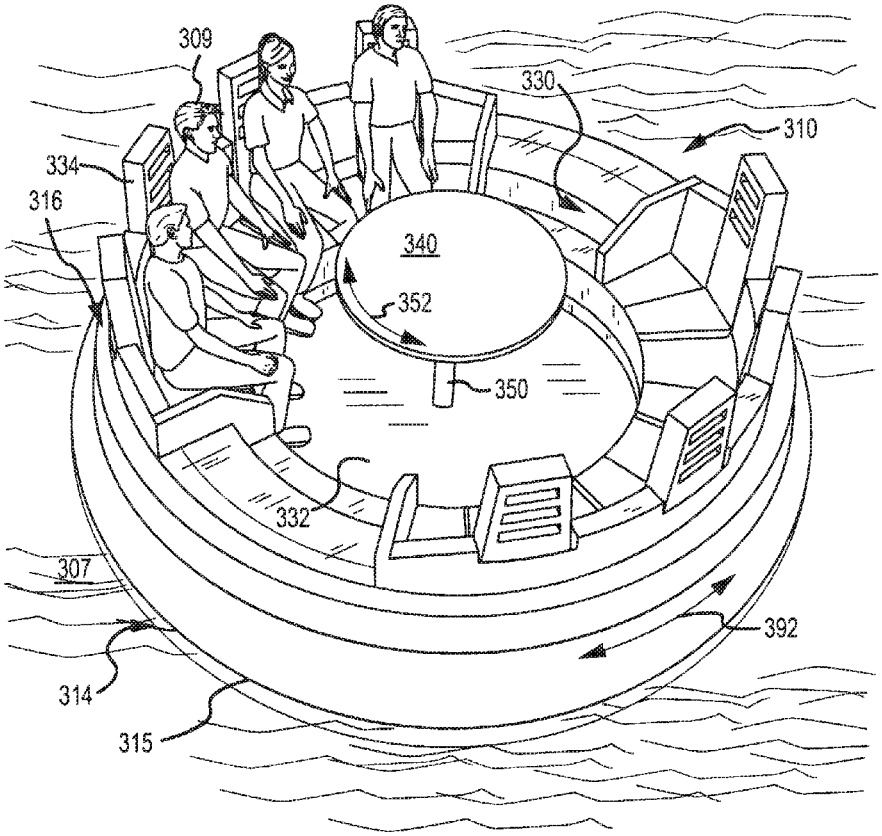
FIGS. 3-5 illustrate a top perspective view, a bottom perspective view, and a sectional view, respectively, of a rotatable boat similar to that shown in FIG. 2 illustrating components of an embodiment utilizing paddles in a recessed cavity in the bottom of the hull to rotate a boat in response to passengers rotating a wheel or rotary handle.
Figure 4:
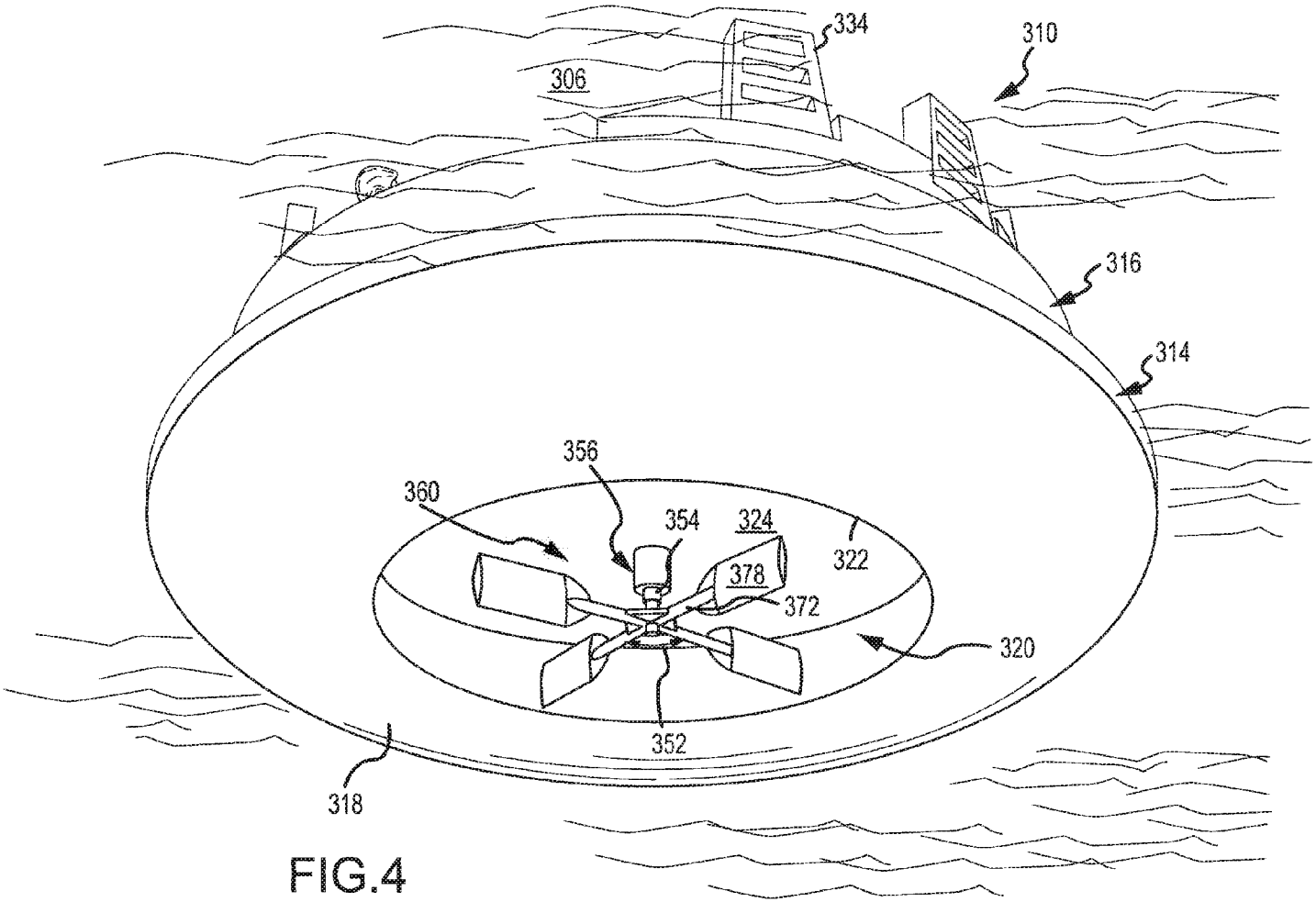
Figure 5:
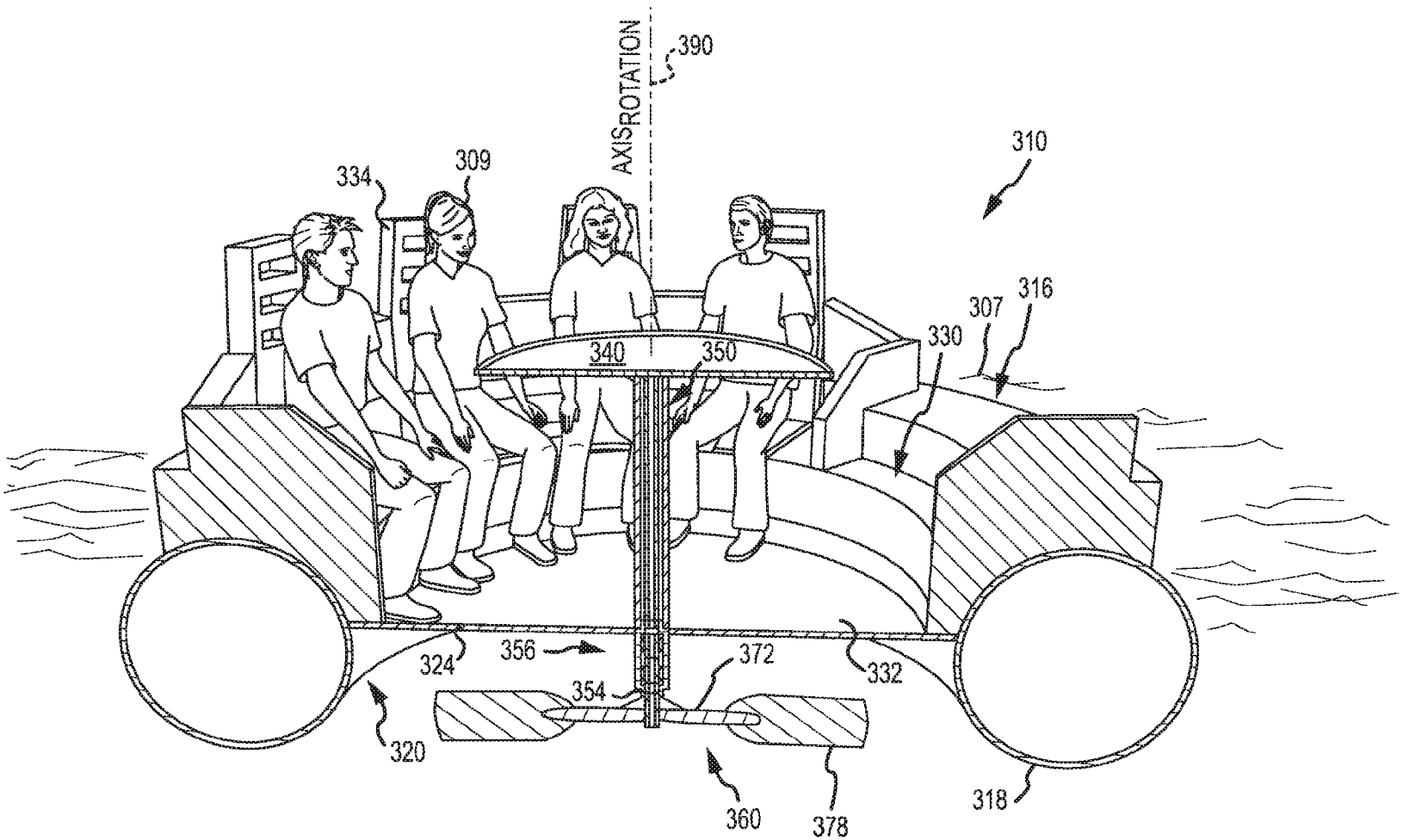

FIGS. 3-5 illustrate another paddle-based embodiment of a passenger-rotatable boat such as may be used in channel or flume rides and in other applications such as for home and resort use in pools, lagoons, and the like. As shown, the boat 310 has a circular hull or body made up of a lower portion 314 below the water line 315 (or expected water line for most passenger loadings) and an upper portion 316 above the water line 315. The boat 310 floats upon the water surface 307 and is rotatable 392 in response to user input of physical energy. The upper portion 316 includes an interaction space or seating well 330 with a deck 332 for supporting the passengers 309 in a standing/sitting/kneeling position or upon seats 334 as shown.

To allow the passengers 309 to input energy, the boat 310 includes a rotary handle or wheel 340 coupled to an axle or drive shaft 350. The passengers 309 may turn 352 the handle/wheel 340 to cause the shaft 350 to rotate in either direction in this example. The shaft 350 is supported on and extends through the deck 332 with pivotal support 356 (e.g., a number of bearings and a shaft that provide a watertight seal and also facilitate rotation of the shaft 350).

FIG. 4 shows that the lower portion 314 includes a landing or contact surface 318 upon which the boat 310 may rest in shallow water 306 or when guided in a channel such as upon rollers or conveyor belts in the bottom of a channel. Further, the lower portion 314 also includes a cavity or recessed surface 320 adjacent to the landing surface 318, and the cavity 320 is defined by a sidewall 322 extending in a circular pattern about the lower end 354 of the shaft 350 and also defined by an upper wall or ceiling 324 opposite the deck 332. The cavity 320 has a depth (e.g., 6 to 18 inches or more) provided or defined by the sidewall 322 in which the lower end 354 of the shaft 350 rests.

The boat 310 includes a paddle assembly 360 affixed to the end 354 of the shaft 350 so as to rotate 352 with the shaft 350 in response to movement by the passengers 307 of the wheel 340. More accurately, in operation, the paddle assembly 360 applies a torque via shaft 350 and wheel 340 to the passengers 309 that is applied to the boat 310 via contact surface in seats 334 as the water 306 within the cavity 320 resists movement of the paddle assembly 360.

To provide such resistance, the paddle assembly 360 is shown to include four paddles each with a blade 378 extending from a shaft 372 attached to the shaft end 354. The shafts 372 extend outward orthogonally from the shaft 350 but may take a smaller or greater angle than 90 degrees in some embodiments (e.g., extend downward from the shaft at an angle greater than 90 degrees or upward from the shaft into the cavity at an angle less than 90 degrees). The shaft 372 may be very short or, as shown, have a length of 6 to 18 inches or more to position the blades 378 out from the shaft 350 and provide a significant lever arm for applying the resistive force of the water 306 on blades 378 to the wheel 340.

The blades 378 are shown to have two faces for contacting the water 306, and these faces are generally perpendicular to the direction of rotation of the blades 378. In other cases, though, three or more faces may be provided on the paddles 378 and/or the faces may be at angles other than 90 degrees to achieve a desired resistive effect in water 306. Again, the shape and size of the faces of the paddle blades 378 may be varied to practice the boat 310 with a surface area of at least about 0.5 to 1.0 square feet or more being desirable. The number of paddle blades 378 may be 4 as shown or a smaller or larger number (e.g., 2 may be used or 6 or more may be useful in some cases such as with a larger boat). More importantly, in many embodiments, most or all of the blades 378 are positioned fully within the cavity 320 with the blades 378 a distance from the contact surface 318 as measured toward the top wall or ceiling 324 (or deck 332). The resistance and turning of the boat 310 occurs due to the presence of the water 306 in the cavity 320 and not due to movement of water 306 in a channel or the like.

As discussed with reference to FIG. 1, the invention may be implemented using a variety of differing rider interfaces, force transmission elements, and torque producing elements (with boat and water interfaces or reactive surfaces/elements). With the paddle-based design understood, it may now be useful to describe a pump and nozzle-based design for allowing passengers to provide input to rotate their boat on a water surface.

Figure 6:
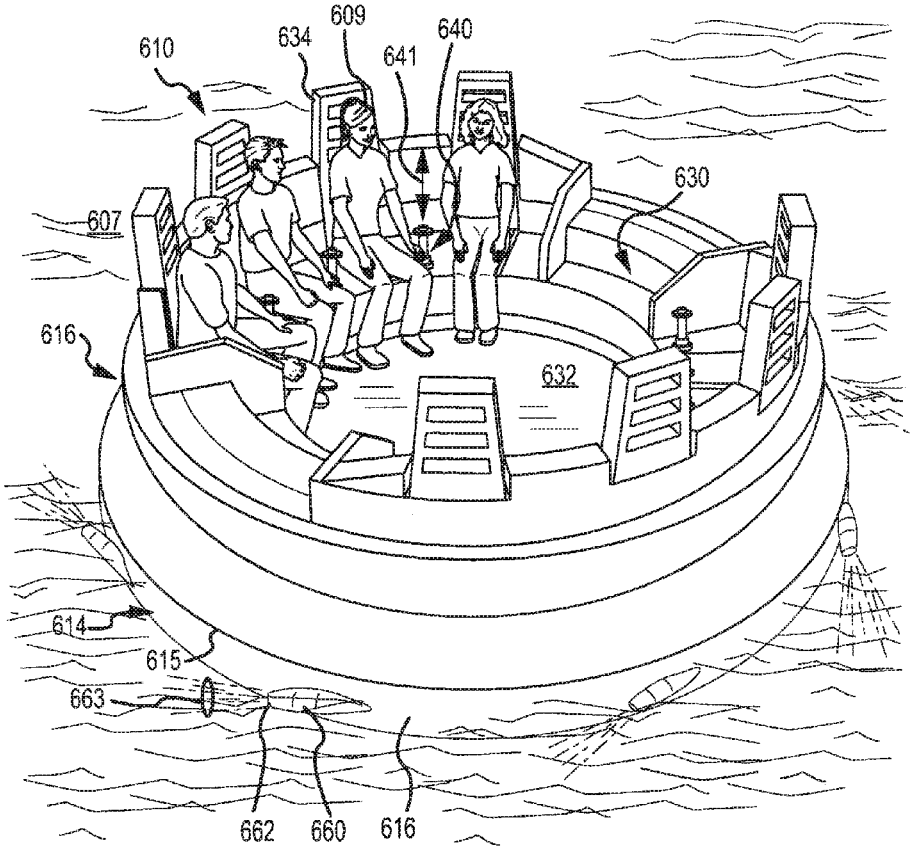
FIGS. 6 and 7 illustrate a top perspective view and a top view, respectively, of another rotatable boat similar to those shown in FIGS. 2-5 that uses passenger-pumped water expelled from nozzles to rotate the boat's hull in the water.
Figure 7:
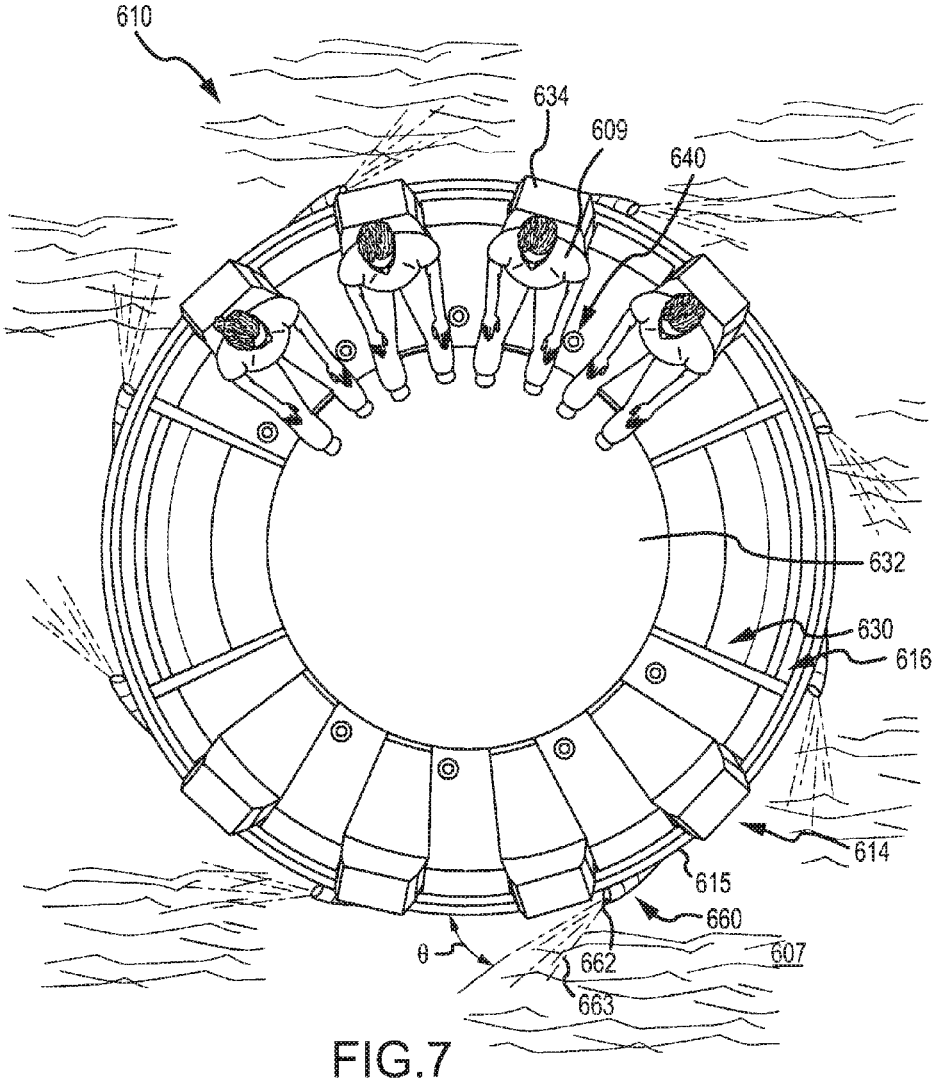

FIGS. 6 and 7 illustrate a boat 610 floating on the surface 607 of a volume of water such as in still water of a lake or pool or in flowing water of a channel or flume ride. The boat 610 includes a circular hull with a lower portion 614 below the waterline 615 and an upper portion 616 above the waterline 615 (or designed waterline/waterline area). A well or seating space 630 with a deck 632 is provided for supporting seats 634 for passengers 609, and the passengers 609 face inward in this non-limiting example as they may face in nearly any direction in the pump-nozzle embodiment of boat 610.

The boat 610 further includes a number of manual (or manually actuated) pumps 640 provided near each passenger seat 634. The pumps 640 may include handles or grips that can be moved up and down or side to side to pump water 607 from an inlet (not shown) in hull in lower portion 614 through a number of nozzles 660. As shown, the nozzles 660 are positioned about the periphery of the hull in the lower portion 614 so as to be below the waterline 615.

The outlets 662 of the nozzles 660 are also underwater or below the waterline 615 such that the surrounding water 607 resists the discharge or ejection of outlet or pumped water 663. This resistance applies a torque or force to the nozzles 660 to cause the boat 610 to rotate in the water 607. The nozzles 660 typically are spaced apart about the periphery or circumference of the outer wall of lower portion 614 of the hull, and one, two, or more pumps 640 may feed water to each nozzle 660. The number of nozzles 660 may be one to 6 or more per boat 610. The outlets 662 of the nozzles 660 may be angled outward at a discharge angle, θ, of 15 to 45 degrees or more to more effectively apply the resistive force to the lower portion 614 to spin the boat 610. The outlets 662 may discharge 663 parallel to the waterline 615 as shown to translate a larger percentage of the resistive force to rotating the boat hull or may be angled downward (or upward) from a plane parallel to the waterline 615 to achieve a desired effect. The design of the nozzle outlet 662 may also be selected from a wide range of discharge nozzles or outlets to better rotate the boat with less pumping action being required such as to produce a dispersed spray (less force) to a jet or projectile of water (more force).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The rotatable boats described above provide a number of advantages in use in rides and other applications. The passenger interaction adds a new dimension to a raft ride experience with no degradation of the experience for riders that choose not to participate (e.g., do not rotate their raft in the flume). The rotation mechanism may, in some embodiments, not be rigidly coupled to any structure besides the boat; therefore, there is no risk of sudden wrenching movements of the handle or grips when the boat rotates due to external devices (e.g., either an intentional movement provided by the ride design or due to randomly coming in contact with the sides of a channel). The rotation mechanism can be implemented in a relatively simple manner leading to low fabrication, installation, and maintenance costs while increasing guest interaction, engagement, and satisfaction.

The addition of a passenger interactive element enables entertaining attraction concepts using a very simple and slow water way (e.g., a lazy river may be made more exciting by rotating your boat), and this has the potential to reduce the ride footprint and also the costs of such an attraction as additional external equipment is not required. Interaction may be enhanced by using external elements such as dripping water that passengers may either want to rotate into or rotate away from (and their "friend" into). Small boats that provide passenger control over movement open up new types of water ride experiences that have a natural and intimate feel that may be similar to tubing down a river. Many existing water rides may be retrofitted to carry a fleet of passenger-rotatable boats with no change being required to the channel or other aspects of the ride design.

We claim:

1. A boat for rotating in response to passenger inputs, comprising:

a hull with an upper portion for receiving at least one passenger and a lower portion comprising a bottom contact surface;

a rider interface, provided on the upper portion of the hull, configured for receiving physical input from the passenger; and a torque producing assembly with a boat-to-water interface provided on the lower portion below a waterline region and above the bottom contact surface, wherein the boat-to-water interface applies a force to water adjacent to the lower portion of the hull in response to the received physical input, whereby the boat rotates due to a resistive force applied by the water in response to the applied force, and wherein the boat-to-water interface comprises at least two nozzles positioned in spaced apart positions along a periphery of the lower portion of the hull.

2. The boat of claim 1, wherein the rider interface comprises a manual water pump operable by the passenger to pump portions of the water through at least one of the nozzles.

3. The boat of claim 2, wherein the upper portion includes a number of seats for receiving the passengers, wherein the rider interface includes an independently operable one of the water pumps positioned proximate to each of the seats, and wherein the boat-to-water interface includes one of the nozzles fluidically connected with each of the water pumps.

4. A boat for rotating in response to passenger inputs, comprising:

a hull with an upper portion for receiving at least one passenger and a lower portion comprising a bottom contact surface;

a rider interface, provided on the upper portion of the hull, configured for receiving physical input from the passenger; and a torque producing assembly with a boat-to-water interface provided on the lower portion below a waterline region and above the bottom contact surface, wherein the boat-to-water interface applies a force to water adjacent to the lower portion of the hull in response to the received physical input, whereby the boat rotates due to a resistive force applied by the water in response to the applied force, wherein the lower portion includes a cavity extending upward from the bottom contact surface and defining a space for receiving the boat-to-water interface, wherein the boat-to-water interface comprises a paddle assembly with two or more paddles rotatable in a volume of the water in the cavity in response to the received physical input, and wherein an end of each shaft of each of the paddles is attached to a drive shaft rotating with the received physical input, wherein the paddle shafts extend transverse to the drive shaft, and wherein the drive shaft extends into the upper portion of the hull and is coupled to the rider interface.

5. A recreational boat, comprising:

a hull with an upper portion above a waterline region and a lower portion below a water line region;

a seating well in the upper portion with seats for receiving a plurality of passengers;

a passenger interface manipulatable by a passenger in one of the seats; and a rotation assembly with a boat-to-water interface positioned in the lower portion and operable in response to manipulation of the passenger interface, wherein water adjacent to the lower portion resists operation of the boat-to-water interface to apply a resistive force to the hull to rotate the hull about a rotation axis, wherein the passenger interface comprises a plurality of pumps operable to pump volumes of the water and the rotation assembly includes nozzles with outlets extending out from the lower portion to discharge the pumped volumes into the water adjacent to the lower portion.

6. The boat of claim 5, wherein the pumps are independently operable to selectively discharge the pumped volumes and wherein the nozzle outlets are spaced equidistally about a periphery of the lower portion.

7. A recreational boat, comprising:

a hull with an upper portion above a waterline region and a lower portion below a water line region;

a seating well in the upper portion with seats for receiving a plurality of passengers;

a passenger interface manipulatable by a passenger in one of the seats; and a rotation assembly with a boat-to-water interface positioned in the lower portion and operable in response to manipulation of the passenger interface, wherein water adjacent to the lower portion resists operation of the boat-to-water interface to apply a resistive force to the hull to rotate the hull about a rotation axis wherein the hull has a circular cross sectional shape along the rotation axis, wherein the lower portion includes a cavity with a center line coinciding with the rotation axis, the boat-to-water interface being positioned within the cavity, wherein the passenger interface includes a rotatable handle coupled to a transmission element that is coupled to the boat-to-water interface, whereby the boat-to-water interface rotates with the rotatable handle, wherein the transmission element comprises a drive shaft with a longitudinal axis coinciding with the rotation axis and wherein the boat-to-water interface comprises two or more paddle blades, and wherein the paddle blades are connected to an end of the drive shaft by spaced apart paddle shafts extending outward from and transverse to the drive shaft and further wherein the paddle blades are wholly received within the cavity.

* * * * *